US008079834B2

(12) United States Patent
Gatley, Jr.

(10) Patent No.: US 8,079,834 B2
(45) Date of Patent: Dec. 20, 2011

(54) EXHAUST DILUTION BLOWER HOUSING WITH REMOTE AIR INTAKE

(75) Inventor: William Stuart Gatley, Jr., Cassville, MO (US)

(73) Assignee: RBC Horizon, Inc., Beloit, WI (US)

( * ) Notice: Subject to any disclaimer, the term of this patent is extended or adjusted under 35 U.S.C. 154(b) by 1969 days.

(21) Appl. No.: 10/830,695

(22) Filed: Apr. 23, 2004

(65) Prior Publication Data

US 2004/0258546 A1 Dec. 23, 2004

Related U.S. Application Data

(63) Continuation-in-part of application No. 10/734,775, filed on Dec. 12, 2003, which is a continuation-in-part of application No. 10/116,315, filed on Apr. 4, 2002, now Pat. No. 6,827,560.

(51) Int. Cl.
*F04B 35/04* (2006.01)

(52) U.S. Cl. ..... 417/423.14; 417/423.8

(58) Field of Classification Search ..... 417/423.14, 417/312, 423.8; 126/515, 85 B, 299 R
See application file for complete search history.

(56) References Cited

U.S. PATENT DOCUMENTS

| | | | | |
|---|---|---|---|---|
| 3,403,962 | A * | 10/1968 | Suffron et al. | 431/20 |
| 5,255,665 | A * | 10/1993 | Windon | 126/290 |
| 5,352,099 | A | 10/1994 | Anstine et al. | |
| 5,697,330 | A * | 12/1997 | Yetman et al. | 122/14.21 |
| 6,231,311 | B1 | 5/2001 | Gatley et al. | |
| 6,318,358 | B1 * | 11/2001 | Gatley, Jr. | 126/110 R |
| 6,398,512 | B2 * | 6/2002 | Stewart | 417/53 |
| 6,602,058 | B1 | 8/2003 | Stewart | |
| 6,622,660 | B1 * | 9/2003 | Bajic et al. | 126/80 |

* cited by examiner

*Primary Examiner* — Devon C Kramer
*Assistant Examiner* — Peter J Bertheaud
(74) *Attorney, Agent, or Firm* — Thompson Coburn LLP

(57) ABSTRACT

A blower housing may be used with a climate control furnace or with a water heater and provides cooling of the motor that rotates the blower fan and also provides dilution and cooling of exhaust gases drawn from the furnace or water heater. The housing has an interior dilution compartment that communicates with an elongate conduit. The dilution compartment receives dilution air through the conduit, thereby reducing blower operation noise at the blower housing.

15 Claims, 14 Drawing Sheets

EXHAUST DILUTION BLOWER HOUSING WITH REMOTE AIR INTAKE

This patent application is a continuation-in-part of patent application Ser. No. 10/734,775, filed Dec. 12, 2003, which is currently pending, and which is a continuation-in-part of patent application Ser. No. 10/116,315 filed Apr. 4, 2002, which is currently pending now U.S. Pat. No. 6,827,560.

BACKGROUND OF THE INVENTION (1) Field of the Invention

The present invention pertains to a blower housing that may be used with a climate control furnace or a water heater. The blower housing provides cooling of the motor that rotates the blower fan and provides dilution and cooling of exhaust gases drawn from the furnace or water heater. The housing is designed to receive dilution air from a location that is remote from the housing, thereby reducing blower operation noise at the blower housing.

(2) Description of the Related Art

Home or office furnaces and/or water heaters typically include a blower that operates to draw ambient air into the combustion chamber of the furnace or water heater and to expel exhaust gases or fumes from the furnace or water heater through an exhaust pipe or chimney. The typical blower includes a blower housing having a volute shape and a radial fan or a squirrel cage fan mounted in the blower housing. The blower housing has an inlet vent opening at its center communicating with the center of the fan and an outlet exhaust opening at the periphery of the volute shape communicating with the exhaust pipe or chimney. An electric motor is mounted to the blower housing on an opposite side of the housing from the inlet vent opening. The motor rotates the fan to cause the fan to draw exhaust gases and fumes into the center of the fan in the blower housing through the inlet vent opening and exhaust the gases and fumes from the housing through the outlet exhaust opening.

In use of the typical blower with a typical furnace, the inlet vent opening of the housing communicates with an outlet of the furnace heat exchanger. On operation of the blower motor and rotation of the blower fan, a vacuum is created by the fan in the blower housing that draws ambient air into the combustion chamber of the furnace where it mixes with the gas or other fuel combusted in the combustion chamber. The hot combustion gases and fumes produced by the combustion chamber are then drawn through the heat exchanger of the furnace by the blower. The blower fan draws the combustion gases and fumes from the heat exchanger into the blower housing and expels the combustion gases and fumes through the exhaust pipe or chimney communicating with the exhaust outlet of the blower housing.

The typical operation of the blower employed with a water heater is similar to that of the furnace. On operation of the blower, ambient air is drawn into the combustion chamber where it mixes with the gas or other fuel being combusted. The combustion gases and fumes are then drawn through the heat exchanger of the water heater where they heat the water contained in the heater. The combustion gases and fumes are then drawn from the heat exchanger and through the blower housing and are expelled through the exhaust pipe or chimney by the blower.

Improvements in the typical blower used with a furnace or a water heater have included modifications to the blower housing where rotation of the fan not only draws the combustion gases and fumes from the heat exchanger of the furnace or water heater into the housing before being expelled, but the fan also draws a flow of cooling air over the motor rotating the fan to cool the motor. Modifications to the blower housing have also enabled ambient air to be drawn directly into the blower housing to mix with the heated exhaust gases and fumes drawn into the blower housing to dilute and cool the exhaust gases and fumes with the ambient air prior to their being expelled through the exhaust pipe or chimney communicating with the blower housing. However, these modifications to the typical blower housing have complicated the constructions of the blower housing which increases their manufacturing cost. In addition, the modifications to the typical blower housing have also complicated the assembly of the blower housing to the furnace or water heater with which it is used, resulting in increasing the time required to assemble the housing to the furnace or water heater and thereby increasing the assembly cost of the furnace or water heater. Still further, providing an opening in the blower housing to enable ambient air to be drawn directly into the housing to mix with the heated exhaust gases and fumes to cool the exhaust gases and fumes also enables the noise of operation of the motor and fan to escape from the blower housing.

What is needed to overcome these disadvantages of prior art blower housings used with climate control furnaces and water heaters is a blower housing that provides the benefits of motor cooling and exhaust gas dilution and cooling in a simplified, inexpensive blower housing that is easily assembled to the furnace or water heater with which it is used. The blower housing construction would also reduce the noise of motor and fan operation transmitted through the ambient air opening of the housing.

SUMMARY OF THE INVENTION

The blower housing of the present invention overcomes disadvantages associated with prior art blower housings discussed earlier by providing a blower housing that both draws cooling air over the motor rotating the fan contained in the blower housing and draws cooling and diluting air into the exhaust gases and fumes drawn into the blower housing, where the blower housing has a simplified, inexpensive construction. In addition, the blower housing provides a compartment for the electrical circuitry that controls operation of the blower motor that encloses all of the circuitry components associated with the motor in the blower housing. Still further, the housing is designed with one side of the housing being positioned in a single plane that facilitates mounting of the one side of the housing on a flat surface of the furnace or water heater with which the blower is used.

In addition, a further embodiment of the blower housing is provided with a noise muffler that is positioned over the opening to the housing through which ambient air is drawn to cool the motor and dilute the exhaust gases and fumes. The muffler reduces the noise created by the operation of the motor and fan. The muffler also functions as a protective cover over the opening, preventing the insertion of a person's fingers through the opening where they could be injured by contacting the moving parts of the operating motor. The blower housing is also provided with an ambient air intake opening in the dilution compartment. A length of air conducting conduit communicates with the dilution compartment interior through the air intake opening. The opposite end of the conduit is positioned remote from the blower housing. The noise generated by the operation of the blower is transmitted through the conduit to a location remote from the blower housing.

The blower housing would also be provided with a double-layered wall in the portion of the housing that directs the heated exhaust gases and fumes drawn into the blower housing to the fan. The double layers of the wall would be separated by a void or hollow volume that insulates the exterior layer of the double-layered wall and prevents the exterior layer from heating up to the extent where it could cause injury to a person's hand contacting the exterior layer.

The motor cooling and exhaust diluting blower housing of the invention is constructed with a fan compartment that contains the radial or squirrel cage fan of the blower. The fan compartment has a volute shape with an exhaust inlet opening in one side of the compartment and a shaft hole in an opposite side of the compartment. The peripheral wall of the volute-shaped fan compartment merges into a circular exhaust outlet opening.

The blower housing also has a motor compartment on the side of the fan compartment having the shaft hole. The motor is supported in the motor compartment with the motor shaft passing through the shaft hole to the fan contained in the fan compartment. An inlet vent opening passes through the motor compartment on an opposite side of the motor compartment from the fan compartment. An outlet vent opening exits the motor compartment adjacent its connection to the fan compartment. The inlet vent opening and the outlet vent opening of the motor compartment define a flow path of air that is drawn through the motor compartment on operation of the blower fan that cools the motor contained in the motor compartment. A muffler is mounted over the inlet vent opening and reduces the noise of operation of the motor and fan transmitted through the inlet vent opening. In addition, the muffler is configured to prevent the fingers of a person's hand from being inserted through the inlet vent opening where they could be injured by contacting the operating motor.

The blower housing also includes a dilution compartment on the side of the fan compartment through which the exhaust inlet opening passes. The dilution compartment also communicates with the motor compartment through the vent outlet opening of the motor compartment. Thus, rotation of the fan in the fan housing draws exhaust gases through the dilution compartment and also draws cooling air through the motor compartment and mixes that cooling air with the exhaust gases in the dilution compartment before the mixed air and gases are drawn into the fan compartment.

In the further embodiment of the blower housing, the dilution compartment has a double-layered wall where the heated exhaust gases and fumes are directed by the double-layered wall from the dilution compartment to the fan compartment. The two layers of the double-layered wall are separated by a hollow void that insulates the exterior layer of the double-layered wall from the heat of the exhaust gases.

An air intake opening is provided through the wall of the dilution compartment. An elongate conduit is attached to the dilution compartment at the air intake opening. The conduit conducts ambient air to the interior of the dilution compartment where the ambient air is mixed with and cools exhaust gases drawn into the compartment by operation of the blower fan. The conduit extends along its length to a distal end of the conduit that is positioned remote from the blower housing. Positioning the conduit distal end remote from the housing also positions the noise of blower operation transmitted through the conduit remotely from the housing. In one embodiment, the conduit distal end is positioned remote from the blower housing in the same room of a structure containing the blower housing. In a further embodiment, the conduit distal end is positioned in a separate room of the structure. In a still further embodiment, the conduit distal end is positioned in the exterior environment of the structure.

The blower housing also includes a circuitry compartment that contains the electronic circuitry associated with the blower motor. The circuitry compartment is isolated from the fan compartment, the motor compartment and the dilution compartment except for a small opening to the motor compartment that allows the electric wiring of the motor to pass into the circuitry compartment and a small opening to the fan housing that allow a pressure sensor mounted in the fan compartment to communicate with the circuitry in the circuitry compartment. The exterior wall of the circuitry compartment is removable, providing easy access to the circuitry.

Because much of the electronic circuitry that controls the operation of the blower motor is mounted on the exterior of the furnace or water heater with which the blower is used, the circuitry compartment is located at the side of the blower housing that is positioned in a single plane. In addition, because the dilution compartment communicates with the exhaust outlet of the furnace or water heater, the dilution compartment is also located at the side of the blower housing that is positioned in the single plane. This enables the blower housing to be mounted to a flat surface of the furnace or water heater with the circuitry compartment enclosing the circuitry components mounted on the flat surface and the dilution compartment enclosing the exhaust outlet of the furnace or water heater emerging from the flat surface.

DESCRIPTIONS OF THE DRAWINGS

Further features of the invention are set forth in the following detailed description of the invention and in the drawing figures wherein.

DETAILED DESCRIPTION OF A PREFERRED EMBODIMENT

Figure 1:
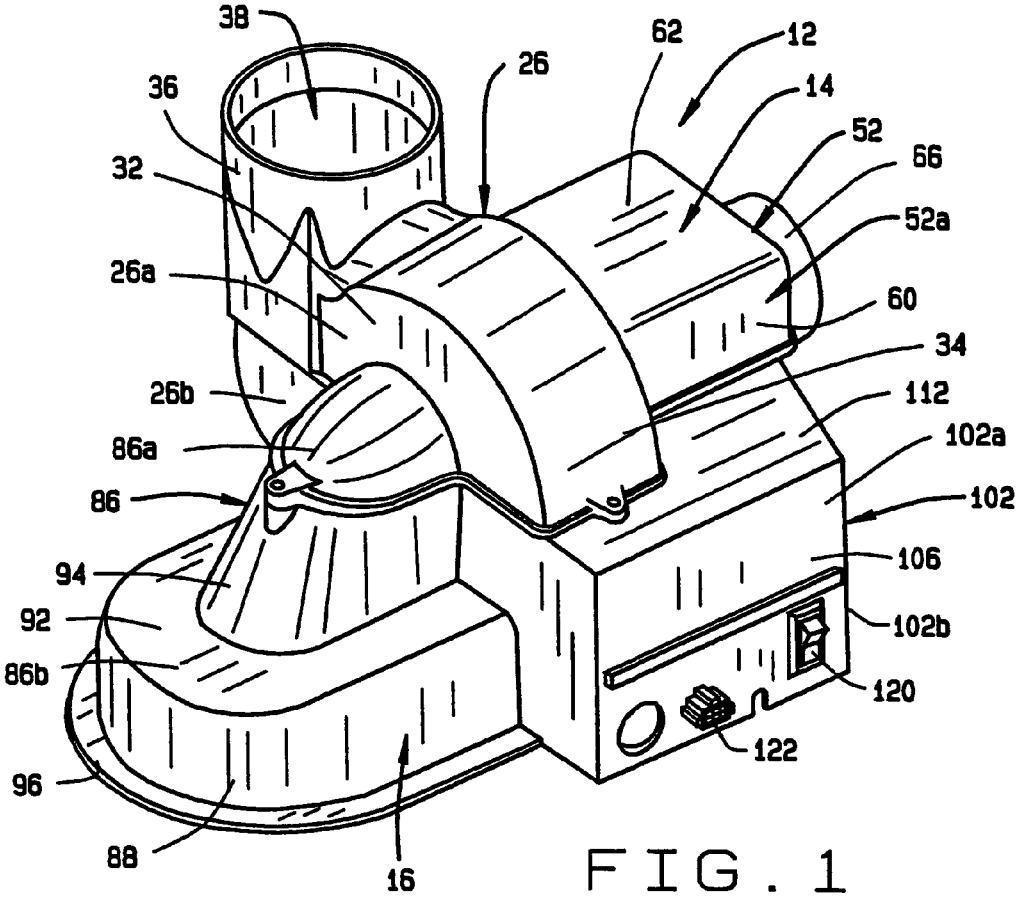
FIG. 1 is a perspective view of one side of the assembled two-piece blower housing embodiment of the invention.

As explained earlier, the blower housing of the invention has a simplified, inexpensive construction and is constructed to both draw cooling air over the motor rotating the fan of the blower and draw cooling and diluting air into the exhaust gases and fumes drawn into the blower housing by the fan. Because the specific construction of the fan, motor and motor electronic circuitry employed with the blower housing are not pertinent to the novel construction of the blower housing itself, these component parts of the blower are shown only schematically in the drawings. In addition, because the novel blower housing of the invention may be employed with a heating furnace or a water heater, the particular construction of the furnace or water heater is not shown in the drawing figures. Only the exhaust gas or fume exit pipe emerging from a flat surface of the furnace or water heater are shown in the drawing figures to illustrate the novel construction of the blower housing that enables it to be easily mounted to the furnace or water heater with which it is used. In the preferred embodiment of the invention, the two pieces of the blower housing to be described are molded of a plastic material. However, other similar types of materials and similar methods of manufacture may be employed.

Figure 2:
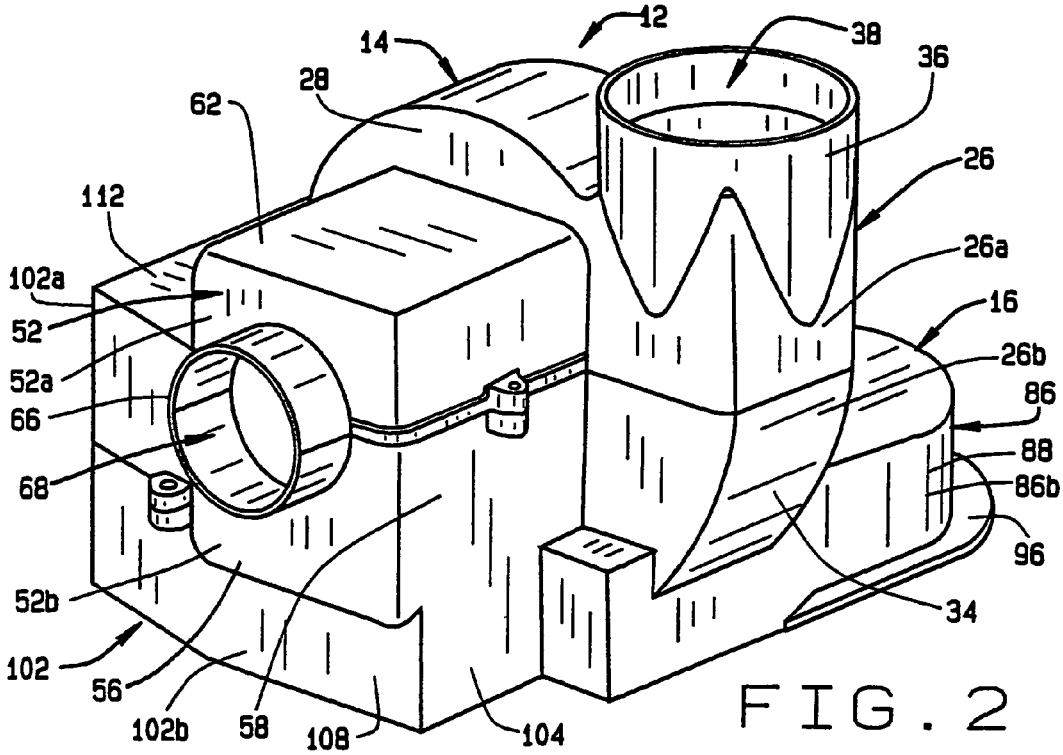
FIG. 2 is a perspective view of the opposite side of the blower housing shown in FIG. 1.

As shown in the drawing figures, a first embodiment of the blower housing (12) of the present invention consists of two pieces including a first, top piece (14) and a second, bottom piece (16). The blower housing (12) is shown in FIGS. 1 and 2 mounted on top of a flat surface (18) of a furnace or water heater relative to the exhaust exit pipe (22) of the heater. Thus, describing the two pieces of the housing as a top piece and bottom piece describe only the relative positions of the two pieces when the housing is mounted on a top surface (18) of a heater. The blower housing (12) is equally well suited for mounting on the flat side surface of a furnace or water heater and therefore the terms "top" and "bottom" used in describing the two housing pieces should not be interpreted as limiting.

The blower housing is constructed with a fan compartment (26) that is enclosed between first and second end walls (28, 32) that are spaced from each other by a volute shaped side wall (34). The side wall (34) spirals around the peripheral edges of the two end walls (28, 32) to a generally cylindrical exhaust exit conduit (36) that emerges from the side wall (34) of the fan compartment. The conduit (36) surrounds an exhaust outlet opening (38) of the fan compartment (26) that communicates with a combustion gas or fume exhaust pipe or chimney (not shown) in use of the blower housing. A shaft hole (42) is provided through the first end wall (28) of the fan compartment and an exhaust inlet opening (44) is provided through the opposite, second end wall (32) of the fan compartment. A pressure sensor opening (46) also passes through the side wall (34) of the fan compartment. As seen in the drawing figures, the two-piece construction of the blower housing (14) divides the fan compartment (26) into a first portion (26*a*) of the fan compartment and a second portion (26*b*) of the fan compartment that separate from each other across the shaft hole (42) and the exhaust inlet opening (44). This enables the fan (48) to be easily assembled into the interior of the fan compartment (26).

The blower housing (12) also includes a motor compartment (52). The motor compartment has opposite first (54) and second (56) end walls, opposite first (58) and second (60) side walls and opposite top (62) and bottom (64) walls. The motor compartment first end wall (54) is actually a portion of the fan compartment first end wall (28) that has the shaft hole (42) extending therethrough. A cylindrical inlet vent collar (66) projects from the motor compartment second end wall (56) and surrounds an inlet vent opening (68) to the motor compartment interior. An outlet vent opening (72) passes through the motor compartment bottom wall (64) adjacent the fan compartment first end wall (28). An additional motor electrical wiring hole (74) passes through the motor compartment bottom wall (64). Motor supports (76) project inwardly from the opposite motor compartment top wall (62) and bottom wall (64) and support the motor (78) in a centered position in the motor compartment interior with the motor shaft (82) projecting through the shaft hole (42) to the fan (48) contained in the fan compartment (26). In use of the blower housing, an ambient air inlet conduit (not shown) is connected to the inlet vent collar (66) to supply cooling, ambient air to the interior of the motor compartment (52). The cooling air circulates around the motor (72) that is centered in the interior of the motor compartment (52) before exiting the motor compartment through the outlet vent opening (72).

The two-piece construction of the blower housing (12) divides the motor compartment into a first portion (52*a*) of the motor compartment and a second portion (52*b*) of the motor compartment. The line of separation between the two motor compartment portions (52*a*, 52*b*) crosses the motor shaft hole (42) and the inlet vent collar (66), facilitating the assembly of the motor (72) into the interior of the motor compartment (52).

Figure 8:
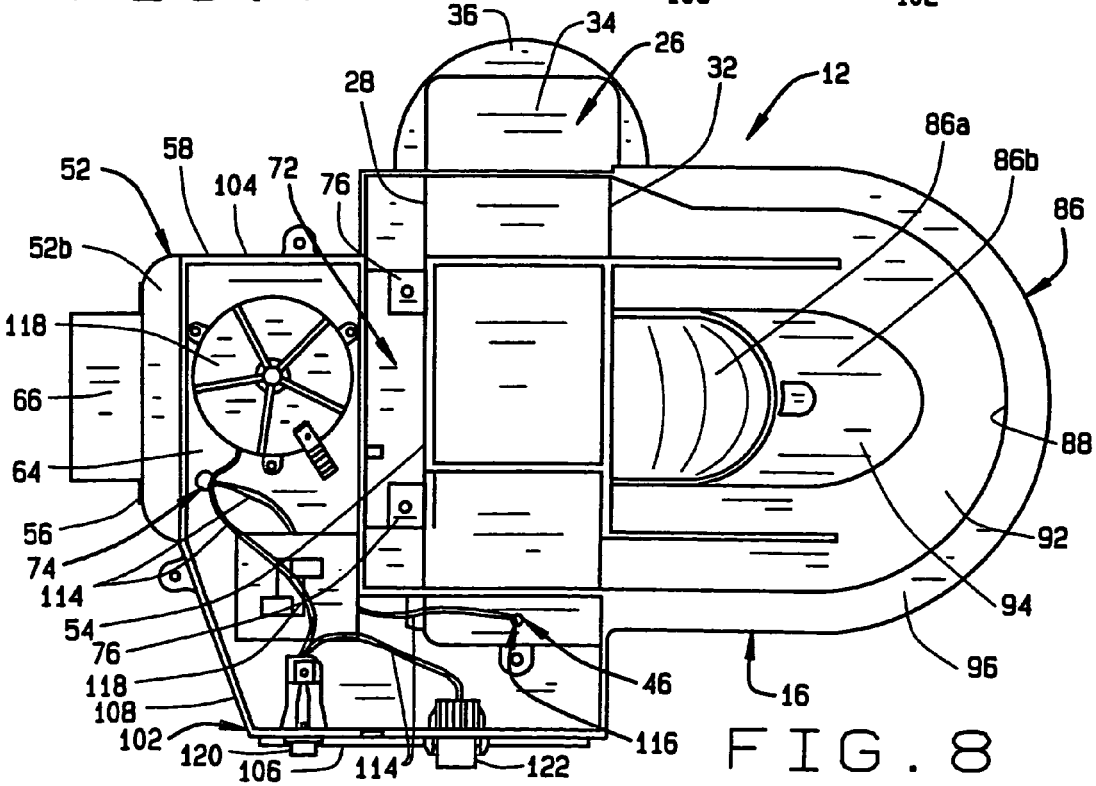
FIG. 8 is a bottom plan view of the blower housing of FIG. 3.
Figure 9:
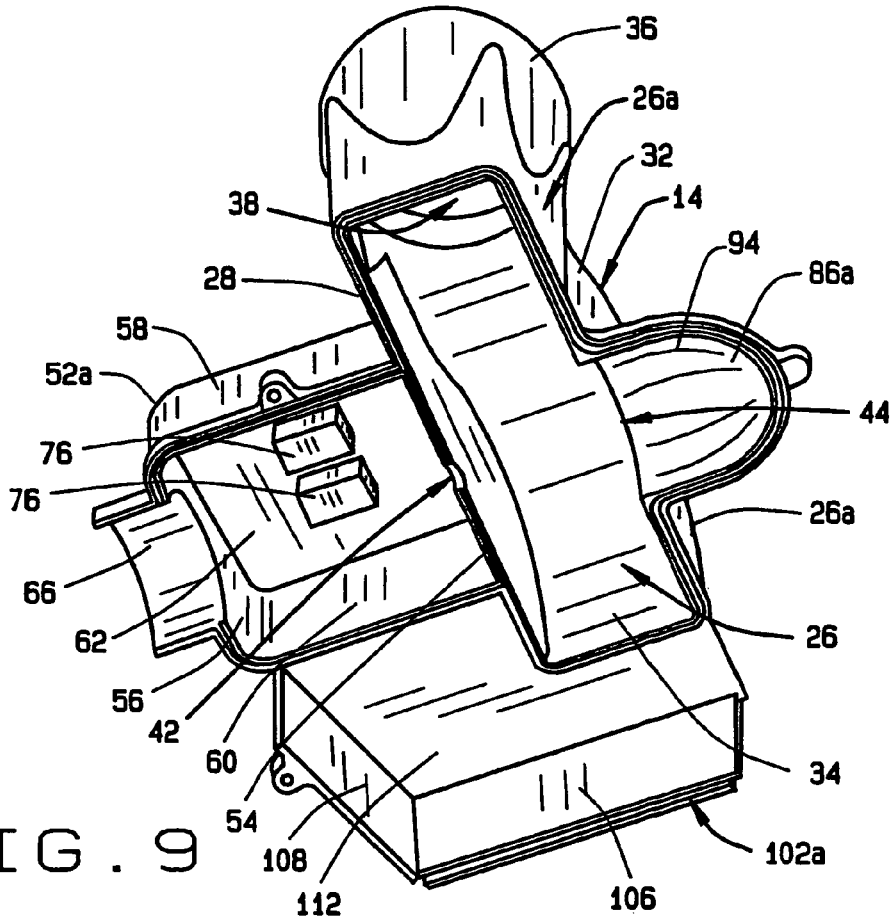
FIG. 9 is a bottom perspective view of the top piece of the blower housing.
Figure 11:
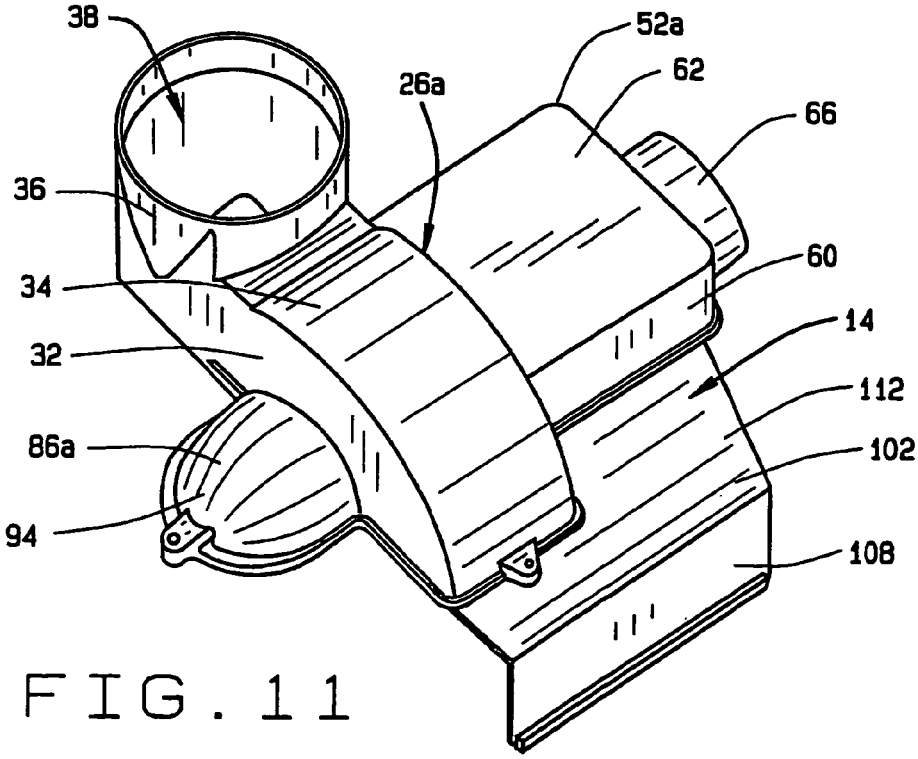
FIG. 11 is a further top perspective view of the housing top piece.
Figure 10:
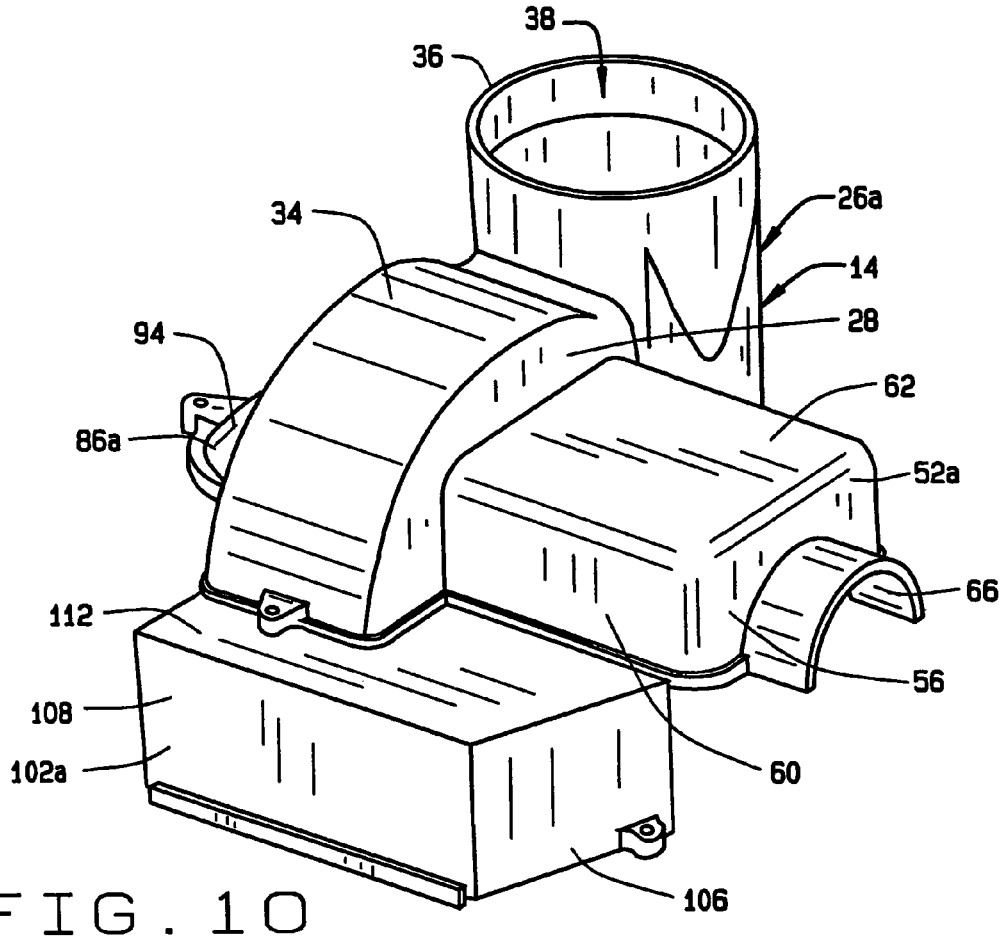
FIG. 10 is a top perspective view of the housing top piece.
Figure 12:
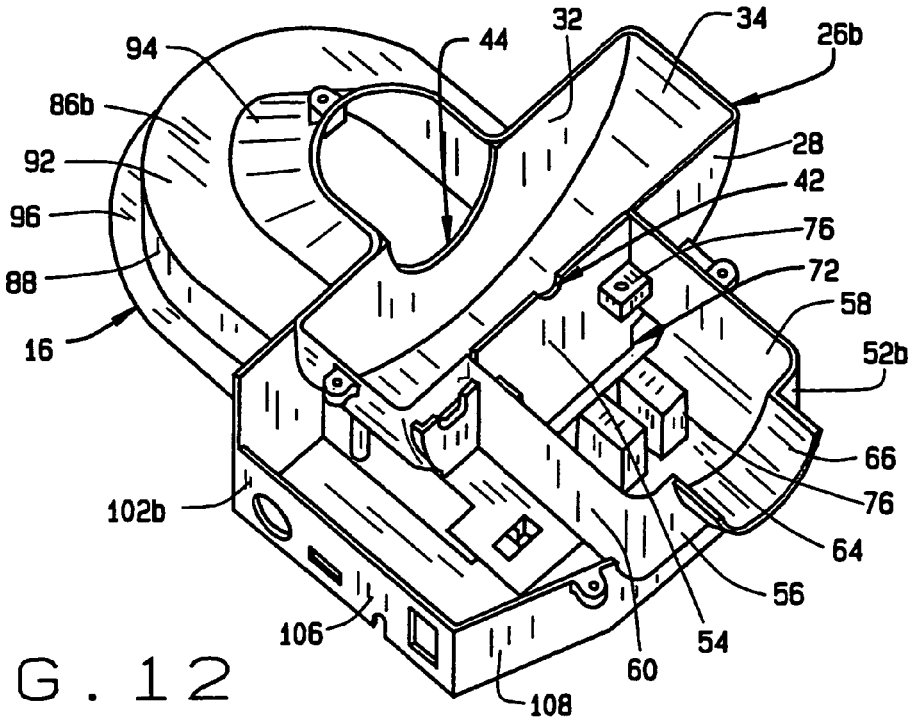
FIG. 12 is a top perspective view of the bottom piece of the blower housing.
Figure 13:
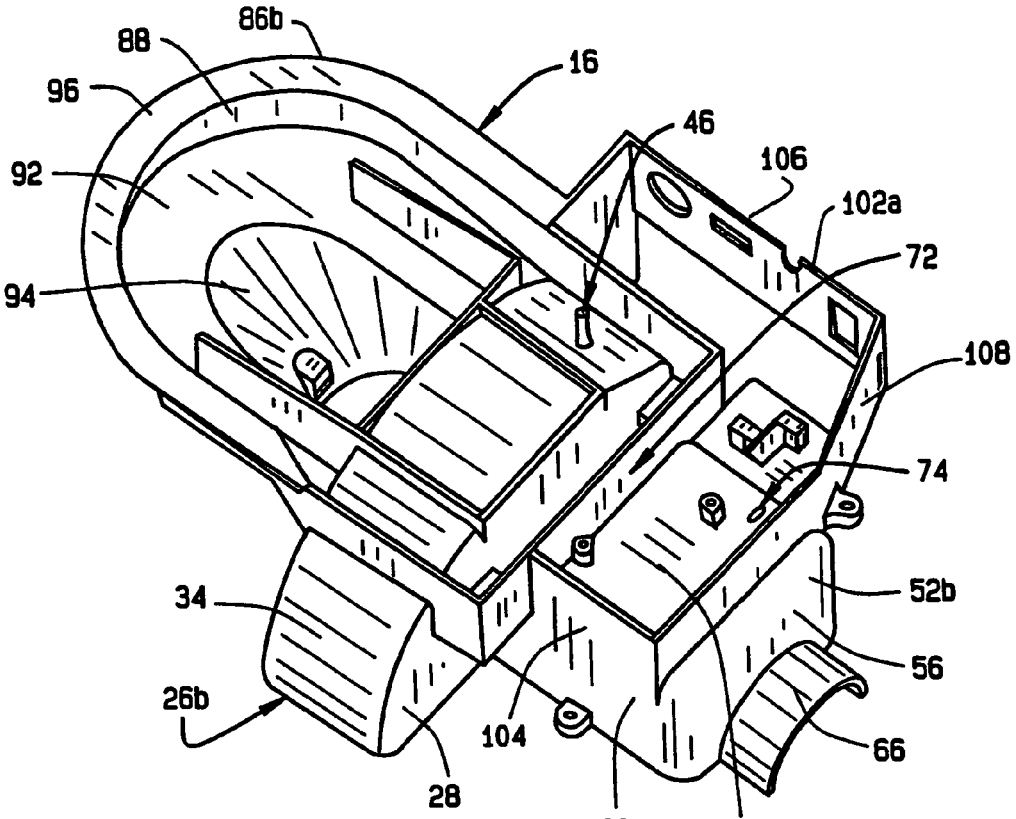
FIG. 13 is a bottom perspective view of the housing bottom piece.
Figure 14:
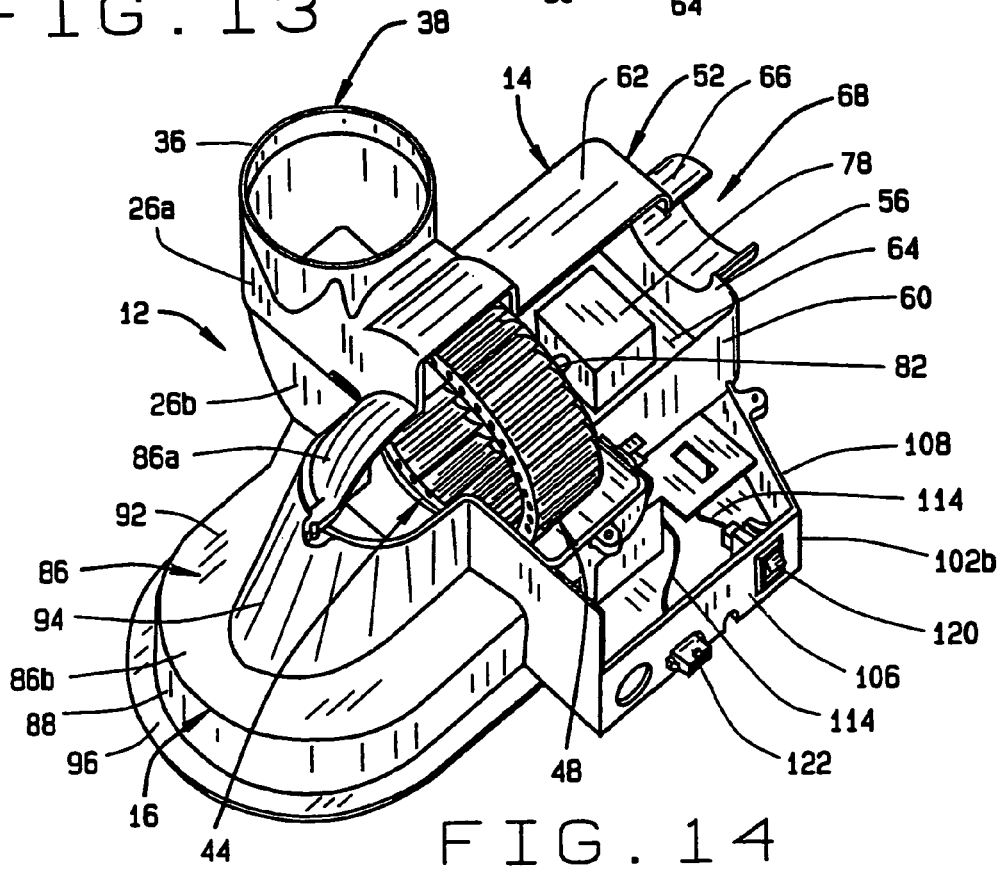
FIG. 14 is a sectioned view of one side of the assembled blower housing.

The two-piece blower housing (12) also has a dilution compartment (86) on an opposite side of the fan compartment (26) from the motor compartment (52). The dilution compartment (86) has a tombstone shaped side wall (88) that is best seen in FIG. 8. A top wall (92) extends over the side wall (88) of the dilution compartment and merges with portions of the walls of the fan compartment (26) and the motor compartment (52). A cowling wall (94) extends upwardly from the dilution compartment top wall (92) and merges with the fan compartment second end wall (32). The cowling wall (94) extends around the exhaust inlet opening (44) that passes through the fan compartment second end wall (32), thereby communicating the interior of the dilution compartment (86) with the interior of the fan compartment (26) through the exhaust inlet opening (44). As best seen in FIG. 8, the dilution compartment side wall (88) also extends around the motor compartment outlet vent opening (72), thereby communicating the interior of the dilution compartment (86) with the interior of the motor compartment (52) through the outlet vent opening (72). The two-piece construction of the blower housing (12) also divides the dilution compartment into a first portion (86*a*) of the dilution compartment and a second portion (86*b*) of the dilution compartment. The dilution compartment side wall (88) has a side wall flange (96) that projects outwardly from the side wall. The flange (96) is employed in attaching the blower housing assembly (12) to the flat surface of a heater with which the housing is used by passing threaded fasteners through the flange and the heater surface or by employing adhesives or other equivalent means of attaching the housing to the heater surface.

The blower housing (12) also includes a circuitry compartment (102) that extends below the motor compartment (52) and along portions of the sides of the motor compartment (52), the fan compartment (26) and the dilution compartment (86). Thus, portions of the walls of these compartments in combination with a pair of opposite end walls (104, 106), a side wall (108) and a top wall (112) of the circuitry compartment enclose the interior of the compartment. The circuitry compartment contains the electronic circuitry associated with the blower motor (78) and isolates the circuitry from the fan compartment (26), the motor compartment (52) and the dilution compartment (86) except for the motor wiring hole (74) and the pressure sensor opening (46). The circuitry contained in the circuitry compartment (102) includes the motor wiring (114) that passes through the motor wiring hole (74) and the pressure sensor (116) that is positioned in the pressure sensor opening (46). Several openings (118) are provided through the circuitry compartment side wall (108) for mounting switches (120) and electrical couplings (122) in the side wall that communicate with the circuitry components contained in the interior of the circuitry compartment (102). Thus, the circuitry compartment (102) contains and protects the circuitry components associated with the electric motor (78) and the pressure sensor (116) as well as other sensors and switches that are typically employed in controlling the operation of the blower motor (78) of a typical furnace or water heater. The two-piece construction of the blower housing (12) also separates the circuitry compartment into a first portion (104*a*) and a second portion (104*b*) of the compartment that separate from each other to enable easy access into the interior of the circuitry compartment (102) that facilitates assembly of the circuitry components into the blower housing.

Figure 3:
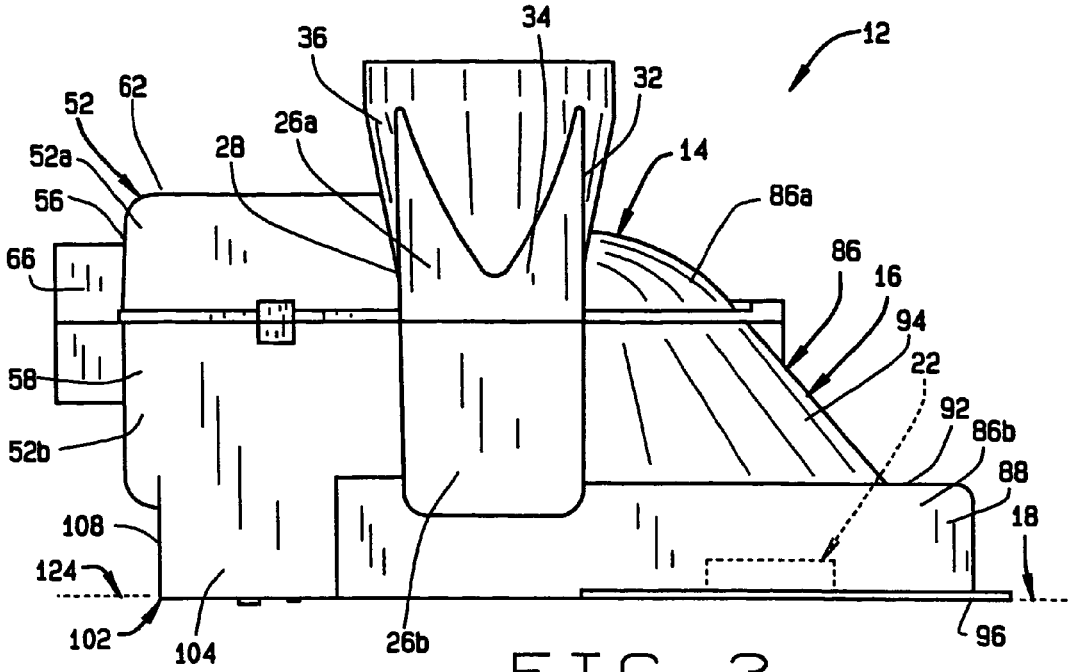
FIG. 3 is a side elevation view of the assembled two-piece blower housing of the invention.
Figure 4:
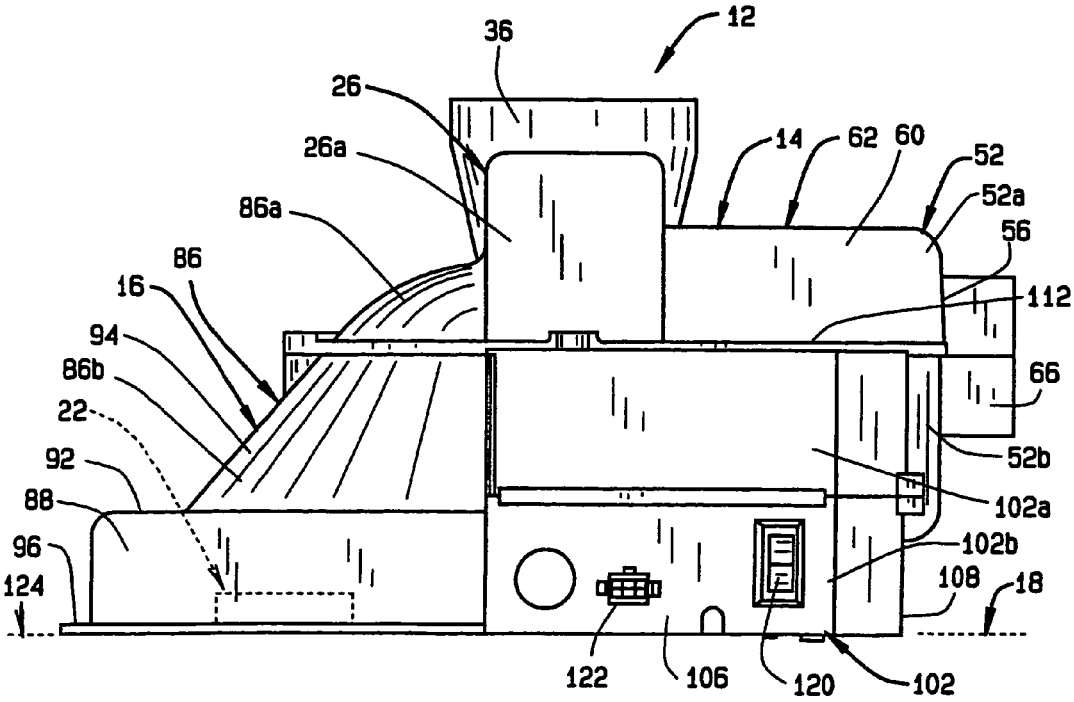
FIG. 4 is an elevation view of the side of the blower housing opposite that shown in FIG. 3.
Figure 5:
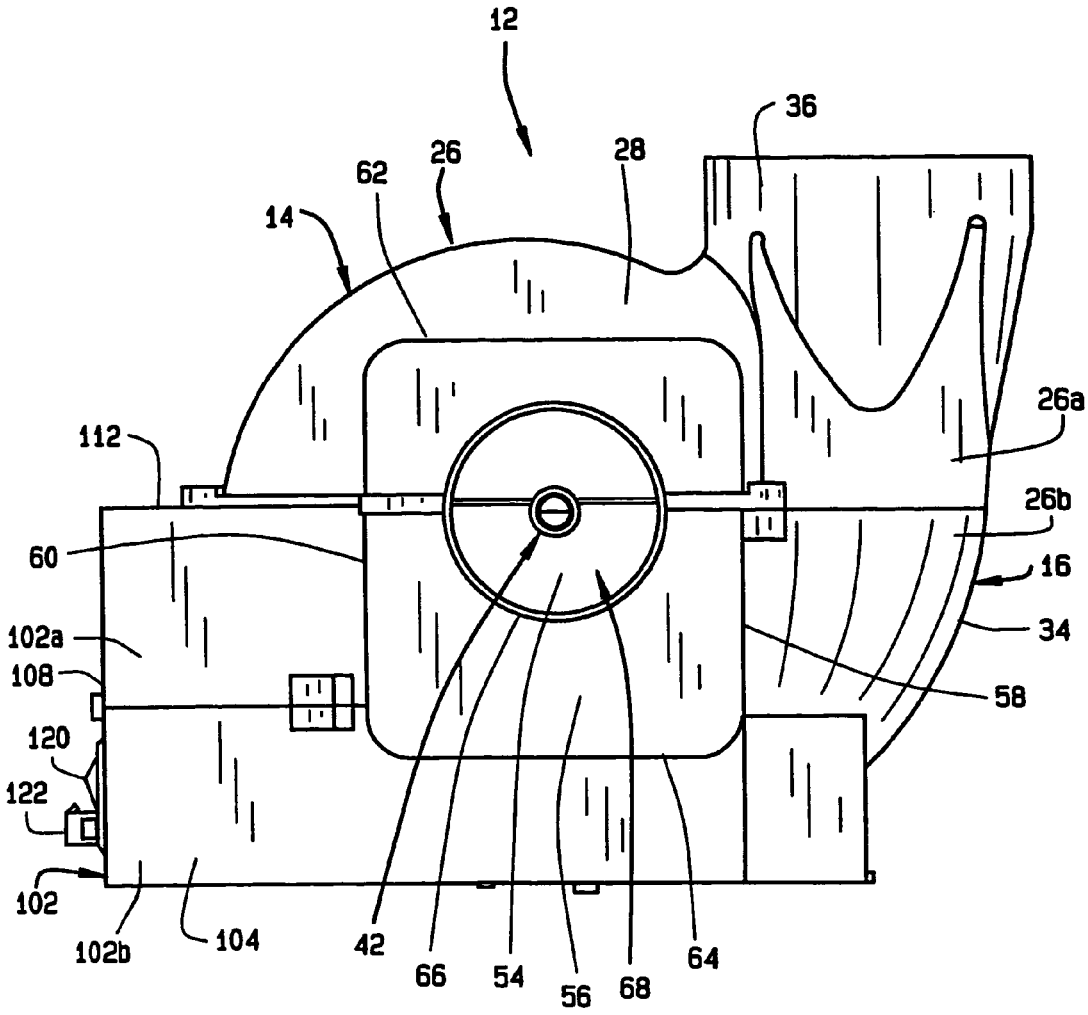
FIG. 5 is an end elevation view of the blower housing of FIG. 3.
Figure 6:
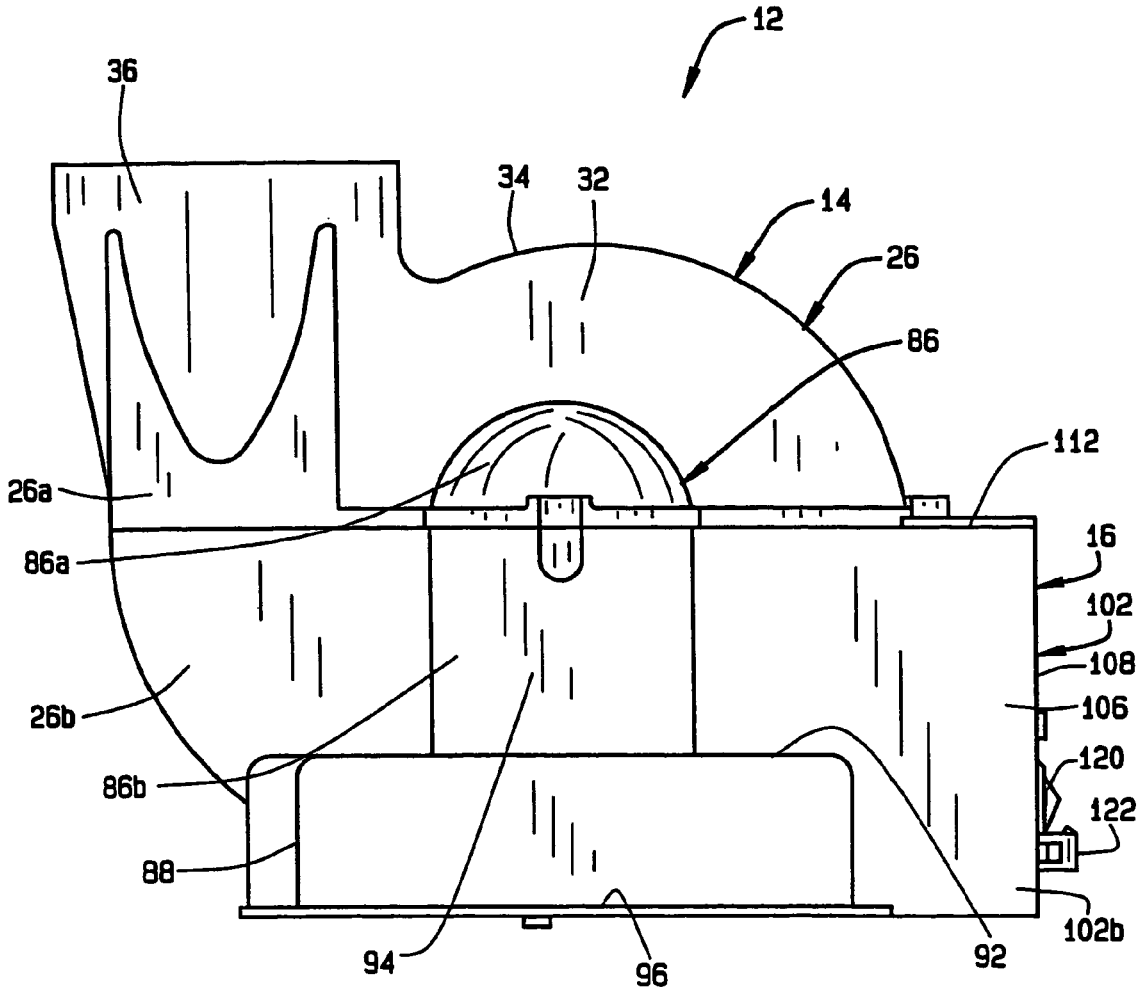
FIG. 6 is an elevation view of the opposite end of the blower housing from that shown in FIG. 5.
Figure 7:
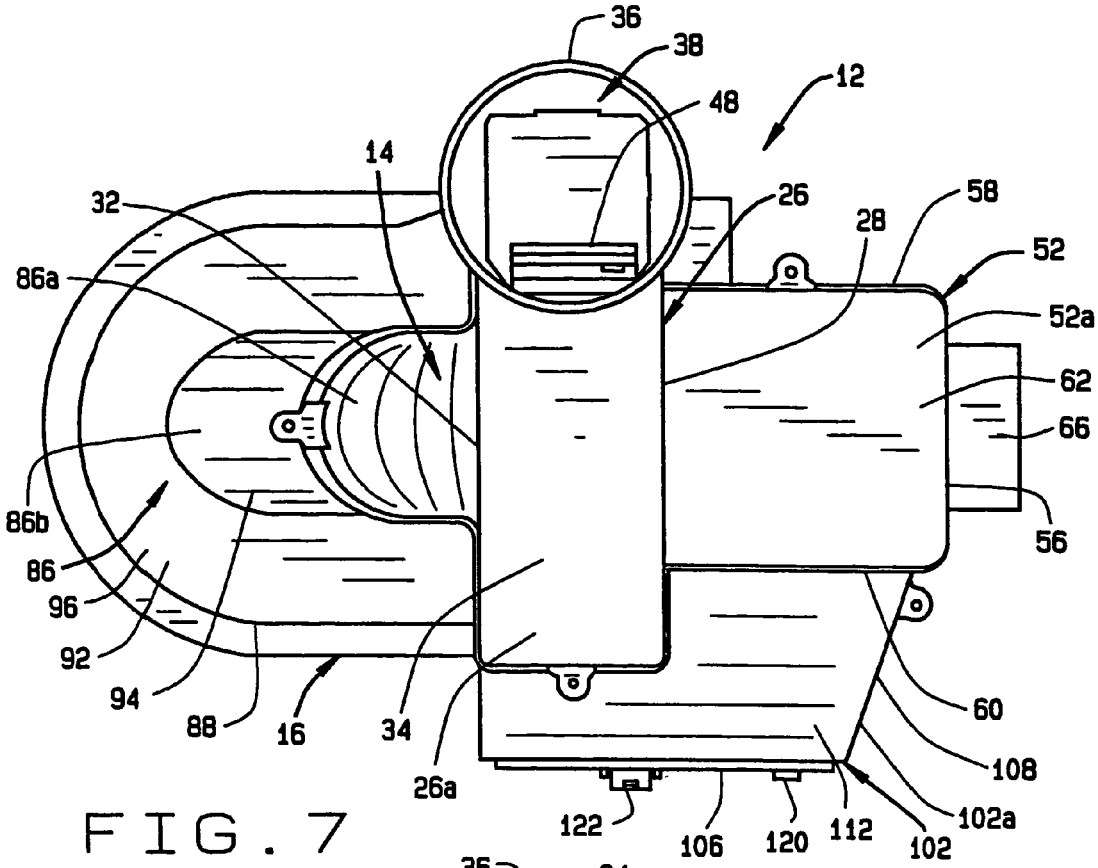
FIG. 7 is a top plan view of the blower housing of FIG. 3.

Because much of the electronic circuitry that controls the operation of the blower motor is typically mounted on the exterior surface (18) of the furnace or water heater with which the blower is used, the circuitry compartment (102) is located at a side of the blower housing (12) that is positioned in a single plane represented by a line (124) shown in FIGS. 3 and 4. In addition, because the dilution compartment (86) communicates with the exhaust exit pipe (22) of the furnace or water heater, the dilution compartment (86) is also located at the side of the blower housing that is positioned in the single plane (124). This enables the blower housing (12) to be mounted to a flat surface (18) of the furnace or water heater with the circuitry compartment (102) enclosing the circuitry components mounted on the flat surface and with the dilution compartment (86) enclosing the exhaust exit pipe (22) of the furnace or water heater emerging from the flat surface.

The arrangement of the fan compartment (26), the motor compartment (52), the dilution compartment (86) and the circuitry compartment (102) in the blower housing described above enable the blower housing to be constructed of only two pieces with each piece being moldable of plastic or other similar material in a two-piece mold. In the two-piece housing construction, portions of the fan compartment (26), the motor compartment (52), the dilution compartment (86) and the circuitry compartment (102) are provided on each piece to facilitate assembly of the fan, the motor and the circuitry in their respective compartments. In addition, the arrangement of the compartments provides a flow path of cooling air drawn into the motor compartment (52) through the inlet vent opening (86) on actuation of the motor (78) and rotation of the fan (48). The cooling air is drawn around the motor (78) cooling the motor and exits the motor compartment through the outlet vent opening (72) at the bottom of the compartment. The air is then drawn into the dilution compartment (86) where it cools and dilutes exhaust gases and fumes that exit the furnace or water heater through the exhaust exit pipe (22). The cooled and diluted exhaust gases and fumes are then drawn into the fan compartment (26) through the exhaust inlet opening (44) and are expelled from the blower housing through the exhaust conduit outlet opening (38) to the exhaust pipe or chimney (not shown) communicating with the exhaust exit conduit (36). Thus, the two-piece blower housing provides cooling of the motor that rotates the blower fan and provides dilution and cooling of exhaust gases and fumes drawn from the furnace or water heater and is also easily mounted to a flat surface of the furnace or water heater.

FIGS. 15-18 show a second embodiment of the blower housing (132) of the present invention that consists of five housing pieces. Many of the housing pieces are substantially the same as those of the first described embodiment of the blower housing (12). Therefore, these common housing pieces will not be described again in detail. Instead, the description of the blower housing of FIGS. 15-18 will concentrate on the differences in the construction of the blower housing from that of the first embodiment of the blower housing. The common features of the second embodiment of the blower housing (132) to that of the first embodiment of the blower housing (12) are identified by the same reference numbers employed in describing these features of the first embodiment of the blower housing, followed by a prime(').

Figure 15:
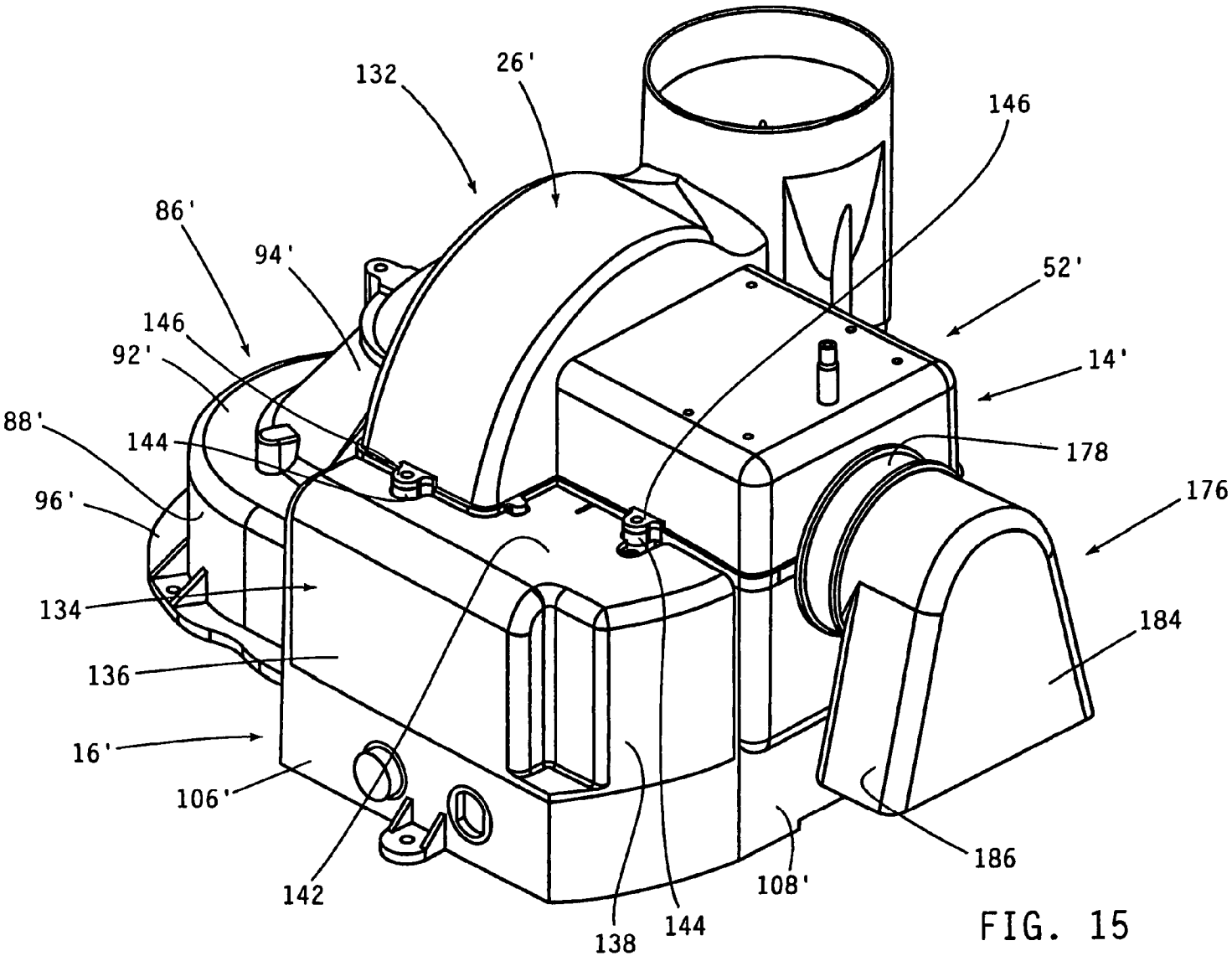
FIG. 15 is a perspective view of a second embodiment of the blower housing of the invention which is comprised of three housing pieces and a muffler and internal heat shield.
Figure 16:
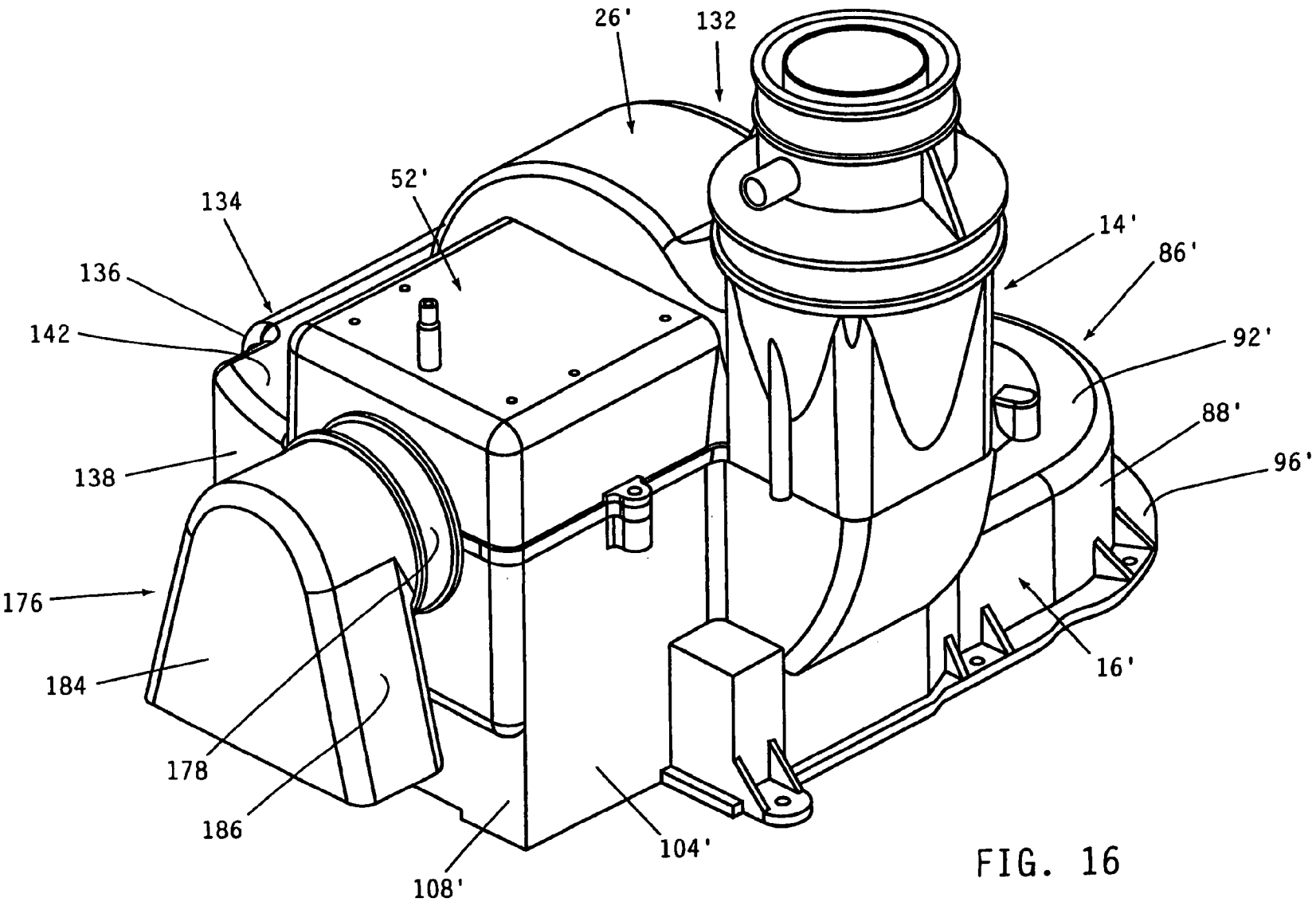
FIG. 16 is a perspective view of the blower housing of FIG. 15 rotated clockwise 90° and with a condensate collector attached to the exhaust conduit.
Figure 17:
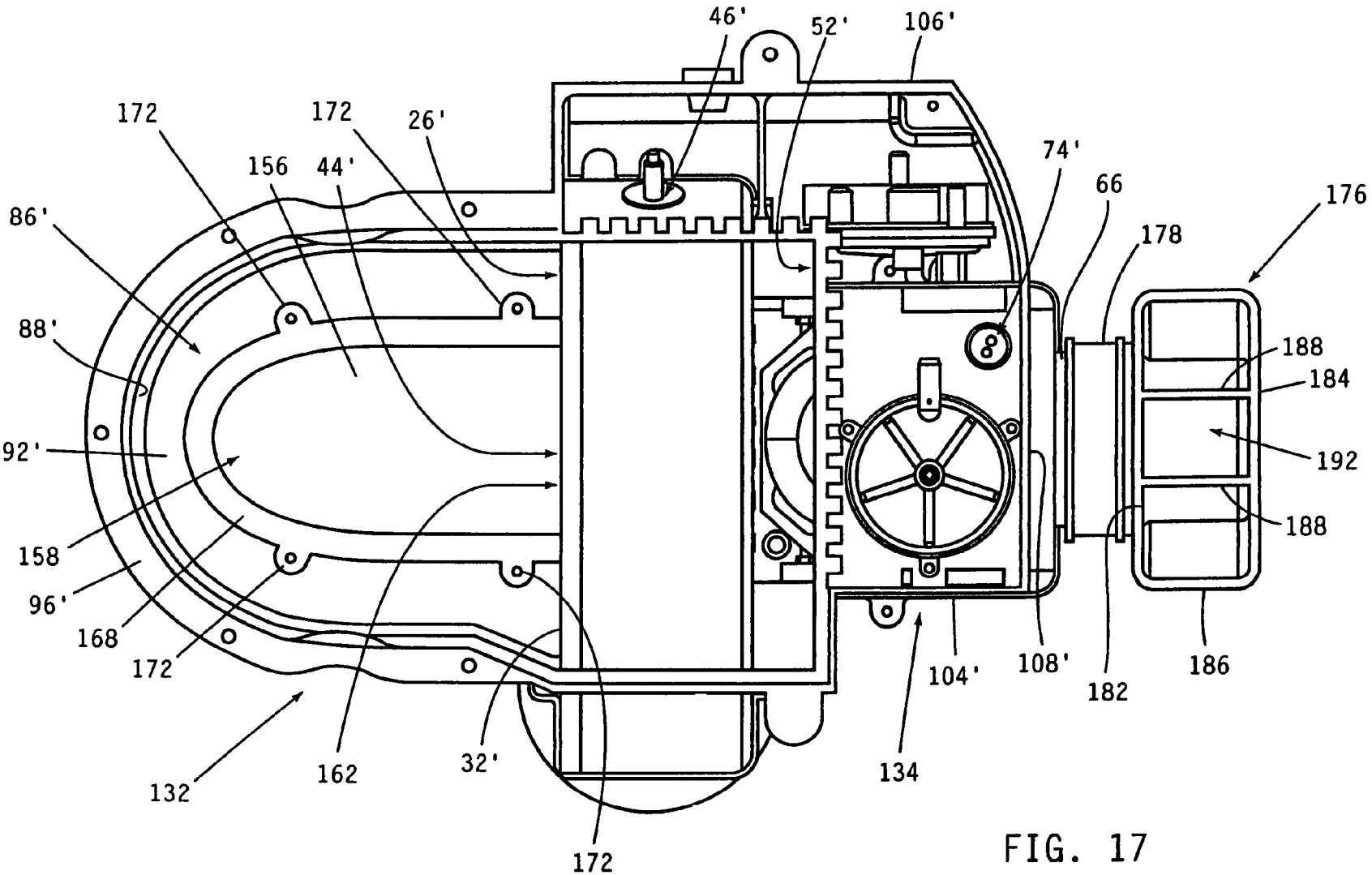
FIG. 17 is a bottom view of the blower housing of FIG. 15.
Figure 18:
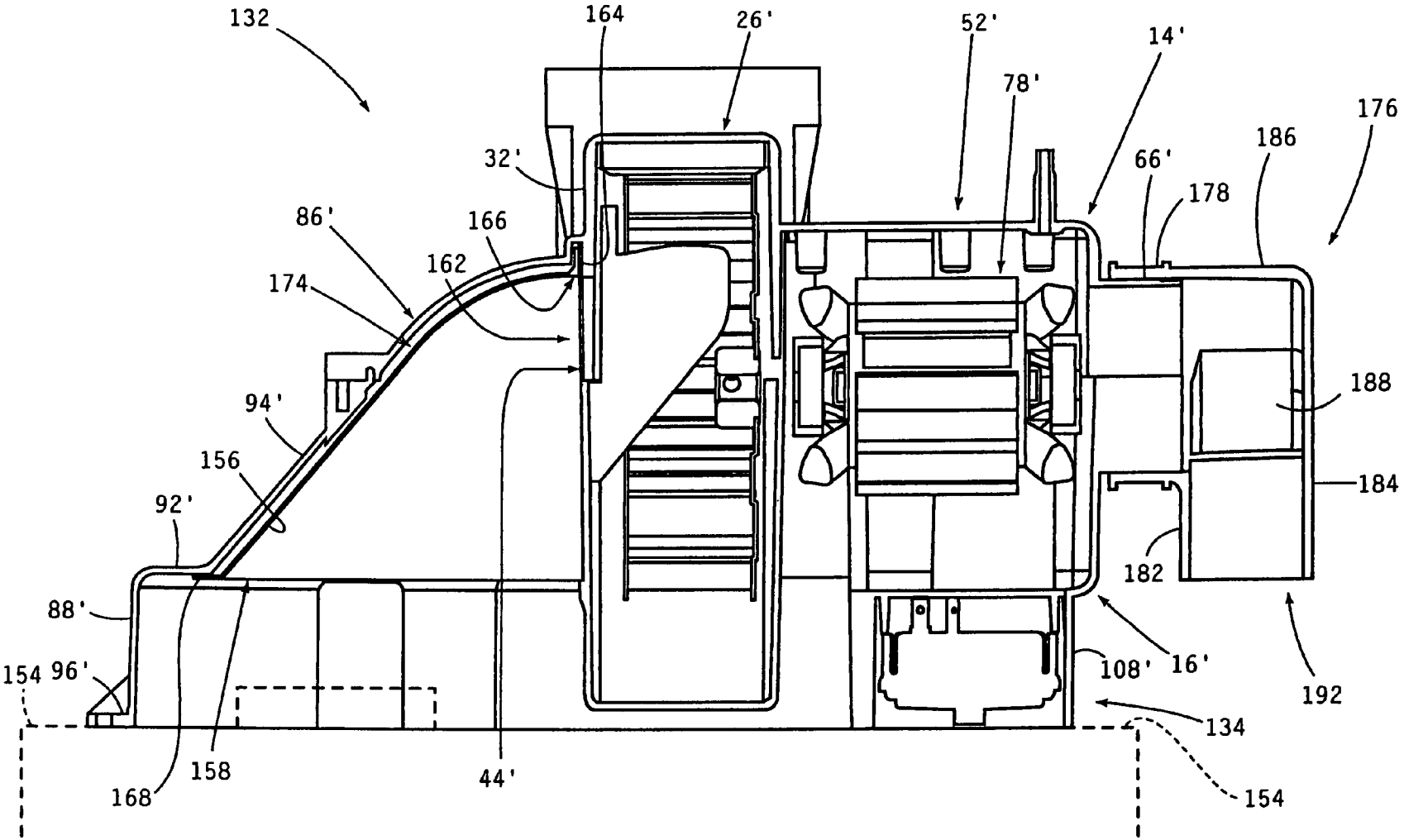
FIG. 18 is a sectioned side view of the blower housing of FIG. 15.

The second embodiment of the blower housing (132) also includes a circuitry compartment (134) that extends below the motor compartment (52'). The circuitry compartment (134) also extends along portions of the side of the motor compartment (52'), the fan compartment (26') and the dilution or exhaust compartment (86') as seen in FIGS. 15, 17, and 18. Thus, portions of the walls of these compartments, in combination with a pair of opposite end walls (104', 106'), and a side wall (108') of the circuitry compartment enclose the interior of the compartment. As in the first described embodiment, the circuitry compartment (134) contains the electronic circuitry associated with the blower motor (78') and isolates the circuitry from the fan compartment (26'), the motor compartment (52') and the dilution/exhaust compartment (86') except for the motor wiring hole (74') and the pressure sensor opening (46').

The circuitry compartment 134 of the second embodiment differs from that of the first embodiment in that the top of the compartment is removable from both the blower housing top piece (14') and the blower housing bottom piece (16'). As best seen in FIG. 15, the circuitry compartment comprises an upper end wall section (136), an upper side wall section (138), and a top wall (142) that can be separated from the blower housing top piece (14') and the blower housing bottom piece (16'). A pair of fastener tabs (144) are provided on the circuitry compartment top wall (142) and align with a pair of fastener tabs (146) on the blower housing top piece (14'). Threaded fasteners can be inserted through the opposed pairs of tabs (144), (146) to removably attach the top piece of the circuitry compartment (134) to the blower housing top piece (14') and the blower housing bottom piece (16'). Removing the fasteners enables the easy removal of the top piece of the circuitry compartment (134) to enable repair or replacement of any of the circuitry components.

The dilution compartment or exhaust compartment (86'), like the first embodiment, is positioned on an opposite side of the fan compartment (26') from the motor compartment (52'). The dilution/exhaust compartment (86') has a tombstone-shaped side wall (88') and a top wall (92') that extends over the side wall and merges with portions of the walls of the fan compartment (26') and the motor compartment (52'). A cowling wall (94') extends upwardly from the dilution/exhaust compartment top wall (92') and merges with the fan compartment second end wall (32'). The cowling wall (94') extends around the exhaust inlet opening (44') that passes through the fan compartment second end wall (32'), thereby communicating the interior of the dilution/exhaust compartment (86') with the interior of the fan compartment (26') through the exhaust inlet opening (44'). The dilution/exhaust side wall (88') also extends around the motor compartment outlet vent opening (72'), thereby communicating the interior of the dilution/exhaust compartment (86') with the interior of the motor compartment (52') through the outlet vent opening (72').

The dilution compartment side wall (88') has a side wall flange (96') that projects outwardly from the side wall. The flange (96') is employed in attaching the blower housing assembly (12') to the flat surface of a heater (154) with which the housing is used. The blower housing assembly is attached to the heater surface (154) by passing threaded fasteners through the flange and the heater surface, or by employing adhesives or other equivalent means of attaching the housing to the heater surface. The exhaust compartment flange (96') defines an exhaust compartment opening that receives exhaust gases from the separate heater to which the blower housing (132) has been attached.

The dilution/exhaust compartment (152) of the second embodiment differs from that of the first embodiment in that it is provided with a layered wall construction. An exterior layer of the layered wall construction is provided by the cowling wall (94') that extends from adjacent the exhaust compartment opening defined by the exhaust compartment flange (96'), to the fan compartment opening or the exhaust inlet opening (44') of the fan compartment.

The interior layer of the layered wall construction is provided by a heat shield (156) inside the dilution/exhaust compartment (152). As shown in FIGS. 17 and 18, the heat shield (156) has a configuration that matches the interior surface of the dilution/exhaust compartment cowling wall (94'). The heat shield (156) has a curved length that extends from adjacent the exhaust compartment opening defined by the exhaust compartment flange (96') to the fan compartment opening or the exhaust inlet opening (44') of the fan compartment (26'). The heat shield (156) also has a concave configuration in cross-section that is received inside the concave cross-section configuration of the cowling wall (94'). This configuration gives the heat shield (156) an arch-shaped input end (158) and an arch-shaped output end (162). An arch-shaped flange (164) extends around the arch-shaped output end (162). The flange (164) engages in a slot (166) in the interior of the blower housing between the fan compartment second end wall (32') and the dilution/exhaust compartment cowling wall (94'). An arch-shaped flange (168) also extends around the input end (158) of the heat shield (156). This flange (168) has several flat tabs (172) that project outwardly from the flange. The tabs (172) receive threaded fasteners that pass through the tabs and into the blower housing. Together the arch-shaped flange (164) at the heat shield output end (162), and the fasteners that extend through the fastener tabs (172) into the blower housing secure the heat shield in place in the interior of the dilution/exhaust compartment (86'). In its position secured inside the dilution/exhaust compartment (86'), the heat shield (156) is opposite the exhaust compartment opening defined by the exhaust compartment flange (96'). The curved configuration of the heat shield (156) directs hot exhaust gases and fumes from the input end (158) of the heat shield adjacent the exhaust compartment opening defined by the exhaust compartment flange (96'), to the opposite output end (162) of the heat shield adjacent the fan compartment opening or the exhaust inlet opening (44') of the fan compartment (26'). In addition, the heat shield (156) is secured inside the interior of the dilution/exhaust compartment (86') with there being a spacing or hollow void (174) between the heat shield (156) and the interior surface of the cowling wall (94'). This space or hollow void (174) insulates the exterior layer or cowling wall (94') of the layered wall construction from the heat of the exhaust gases and fumes that are directed toward the heat shield (156). The insulation provided by the space or hollow void (174) enables a person's hand to come into contact with the exterior surface of the cowling wall (94') without being burned by the exhaust gases and fumes that contact with the heat shield (156). The shield (156) and void (174) also function to provide sound insulation to the blower housing.

A guard or sound muffler (176) is removably attached over the cylindrical vent collar (66') that extends around the inlet vent opening (68') to the motor compartment interior. The guard has a cylindrical sleeve (178) that fits in a snug fit around the inlet vent collar (66'). An adjustable band (not shown) is positioned around the guard sleeve (178) and tightened to removably secure the guard (176) to the inlet vent collar (66'). The guard (176) is formed with a cowling that intersects the guard sleeve (178). The cowling is defined by an inner side wall (182), an opposite outer side wall (184) that is spaced from the inner side wall, and a top wall (186) that extends over the inner side wall and the outer side wall. A pair of interior webs (188) extend between and reinforce the inner side wall (182) and the outer side wall (184). A guard/muffler opening (192) is defined by the bottom edges of the inner side wall (182), the outer side wall (184), and the opposite bottom edges of the top wall (186). The guard/muffler opening (192) is positioned in a plane that is oriented at an angle relative to the plane in which the inlet vent opening (68') is positioned. This creates a non-linear flow path of ambient air through the interior of the guard/muffler (176) to the interior of the motor compartment (52'). This non-linear flow path muffles the noise generated by the motor (78') in the motor compartment (52'). In addition, the positioning of the outer side wall (184) directly opposite the inlet vent opening (68') of the motor compartment (52') prevents the insertion of a person's fingers into the moving component parts of the motor (78') in the motor compartment (52'). Thus, the guard/sound muffler (176) provides the dual function of muffling the sound of operation of the blower housing motor (78') and provides a protective barrier against the inadvertent insertion of a person's fingers through the inlet vent opening (68') of the blower motor housing.

FIGS. 19-22 show a modification to the first described embodiment of the blower housing (12). The blower housing (12) is shown mounted to the top surface (18) of a heater, for example, a residential water heater (202). The exhaust exit conduit (36) of the blower housing is shown communicating with an exhaust flue (212) of the structure (206). The heater is shown positioned enclosed in a room (204) of a residential structure (206). Although the modification of the blower housing (12) is shown in a schematic representation of a residential structure (206), it should be understood that the modified blower housing (12) of FIGS. 19-22 could be used on other types of heaters and in other types of environments.

The embodiment of the blower housing (12) shown in FIGS. 19-22 differs from the first described embodiment in that it is provided with a tubular extension (214) from the housing dilution compartment wall (94). The tubular extension (214) surrounds an air intake opening through the dilution compartment wall (94).

An air conducting conduit (216) is connected to the dilution compartment tubular extension (214). The air conducting conduit (216) has a length extending between an input, proximal end (218) of the conduit and an opposite output, distal end (222) of the conduit. The conduit (216) has a hollow interior bore extending through its entire length. The interior bore communicates with the interior of the blower housing dilution compartment (86).

Figure 19:
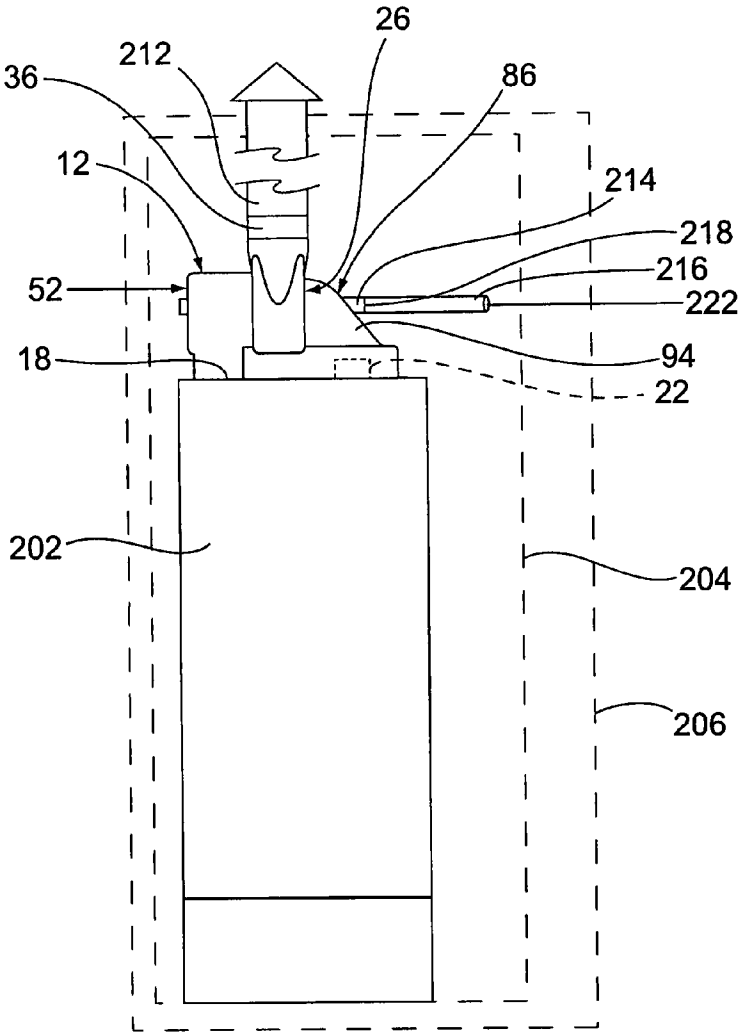
FIG. 19 is a schematic representation of the blower housing mounted to a water heater of a structure, where the conduit distal end is positioned in the same room of the structure containing the blower housing.

In operation of the blower shown in FIG. 19, ambient air is drawn through the interior bore of the conduit (216) from the environment of the room (204) to the interior volume of the dilution compartment (86). The ambient air drawn into the interior of the dilution compartment (86) mixes with the combustion gas exhaust from the exhaust exit pipe (22) cooling the exhaust before it is exited from the structure through the exhaust flue (212). Because the air conducting conduit distal end (222) is positioned remote from the interior of the blower housing (12), the noise generated by the motor and fan operation in the blower housing (12) heard through the interior of the conduit (216) is muffled and attenuated at the conduit distal end (222). In this manner, the air conducting conduit (216) provides dilution ambient air to the interior of the dilution compartment (86) while muffling the noise of operation generated by the motor and fan contained in the blower housing (12).

Figure 20:
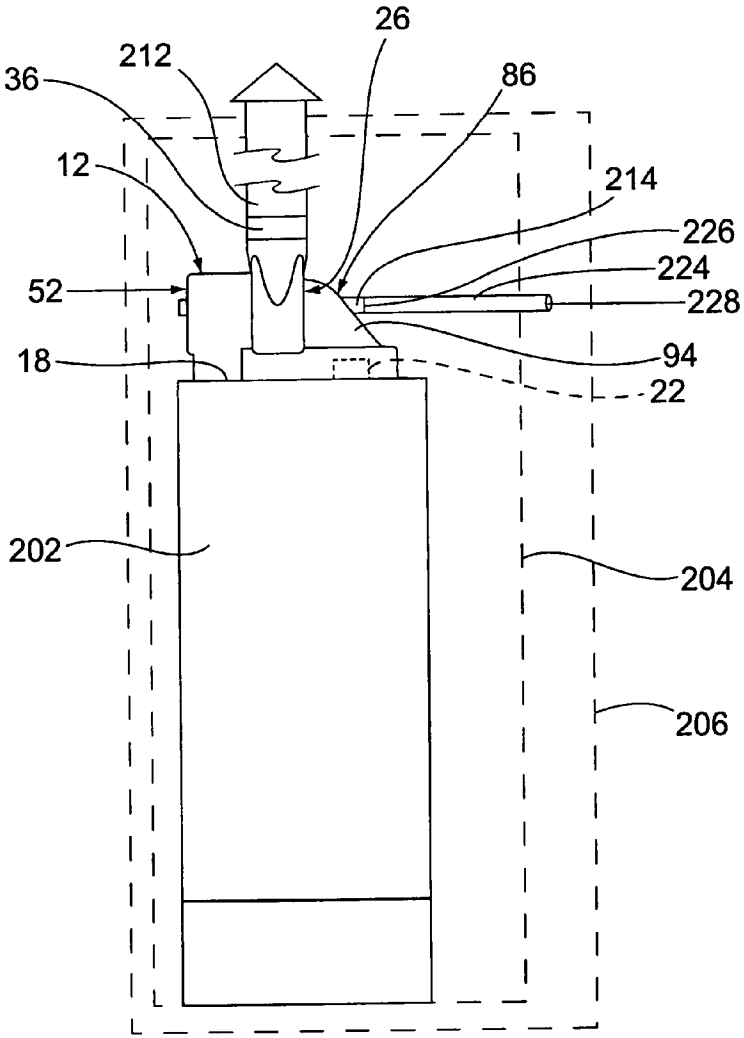
FIG. 20 is a view similar to that of FIG. 19, with the conduit distal end being positioned in a separate room of the structure from that containing the blower housing.

FIG. 20 shows the blower housing (12), the heater (202), and the room (204) contained in the residential structure (206) shown in FIG. 19. The embodiment of the blower housing (12) shown in FIG. 20 differs from that of FIG. 19 in that the air conducting conduit (224) of FIG. 20 has a greater length. With the conduit proximal end (226) being connected to the tubular extension (214) of the dilution compartment (86) as in the previously described embodiment, the length of the conduit (224) positions a distal end (228) of the conduit outside of the room (204) containing the heater (202) and blower housing (12). The conduit distal end (228) is still positioned in the residential structure (206), but in a remote room of the structure. This communicates the air intake in the dilution compartment tubular extension (214) with an exterior environment outside of the room (204), but inside the structure (206).

Figure 21:
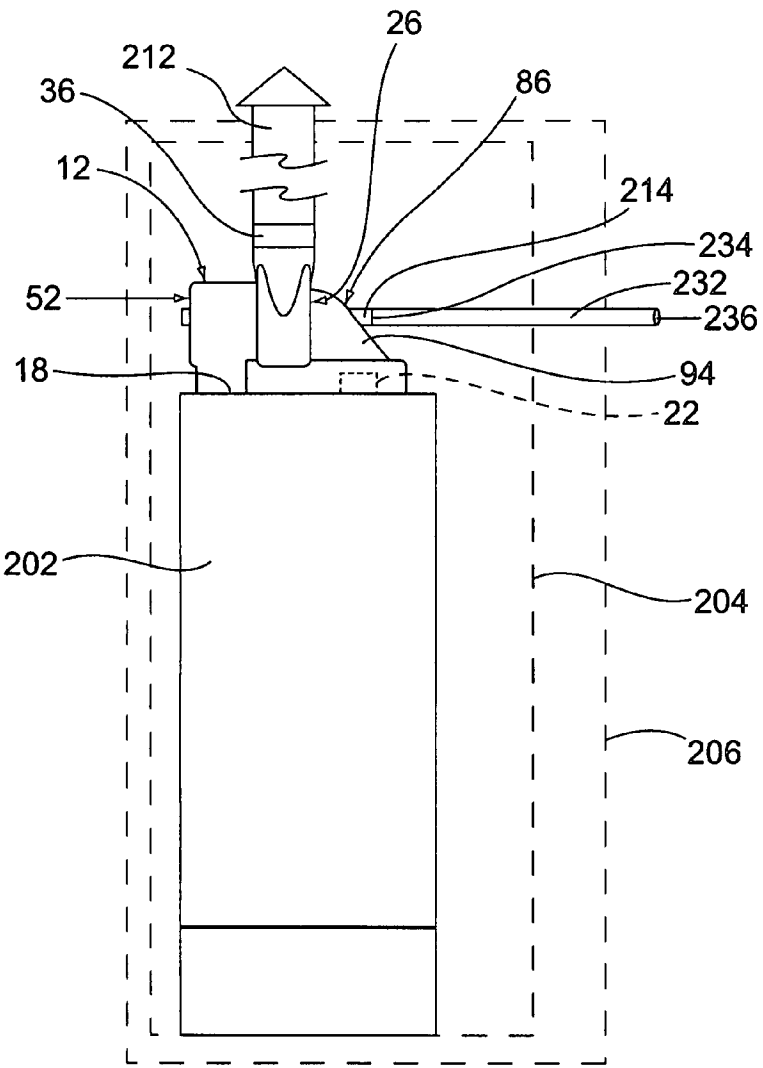
FIG. 21 is a view similar to that of FIG. 19, with the conduit distal end being positioned in an exterior environment of the structure housing the blower housing; and, FIG. 22 is a view similar to that of FIG. 19, with the conduit distal end communicating with the interior of a combustion chamber of the water heater.

FIG. 21 shows the blower housing (12), the heater (202), and the room (204) of the structure (206) shown in FIG. 19. The embodiment of the blower housing (12) shown in FIG. 21 differs from that of FIG. 19 in that the air conducting conduit (232) of FIG. 21 has a greater length. With the conduit proximal end (234) connected to the tubular extension (214) of the dilution compartment (86) as in the FIG. 19 embodiment, the increased length of the conduit (232) positions the conduit distal end (236) outside the room (204) and outside the structure (206). This remote positioning of the conduit distal end (236) communicates the air intake in the dilution compartment tubular extension (214) with the exterior environment of the structure (206).

Figure 22:
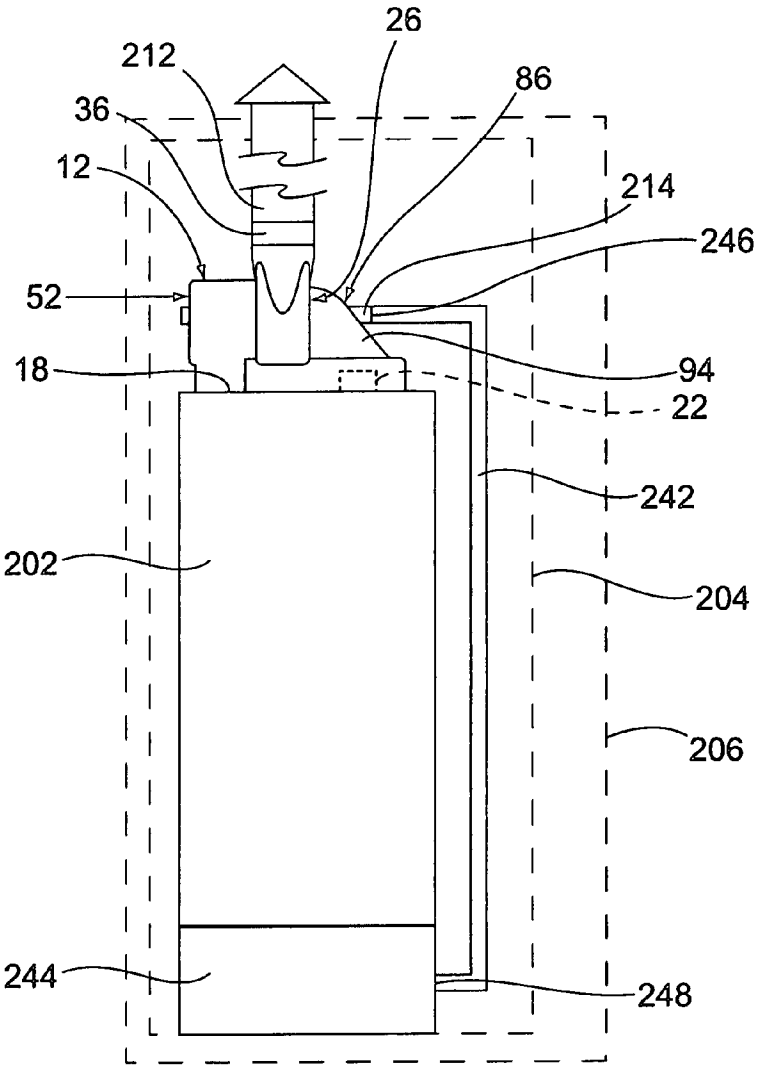

FIG. 22 also shows the blower housing (12), the heater (202), and the room (204) contained in the structure (206) of FIG. 19. The embodiment of the blower housing (12) shown in FIG. 22 differs from that of FIG. 19 in that the air conducting conduit (242) of FIG. 22 has a length that communicates a combustion chamber (244) of the heater with the interior of the blower housing dilution compartment (86). The conduit proximal end (246) is connected to the dilution compartment tubular extension (214) as in the previously described embodiments. The conduit extends from its proximal end (246) to its distal end (248) which is connected to the combustion chamber (244), communicating the interior of the conduit with the interior of the combustion chamber. The conduit distal end (248) is again positioned remote from the blower housing (12). The air intake in the dilution compartment tubular extension (214) is communicated with the exterior environment of the blower housing (12) through the conduit (242) and the combustion chamber (244), communicating the interior of the dilution compartment (86) with air drawn into the combustion chamber (244) which is also drawn through the length of the conduit (242).

While the present invention has been described by reference to a specific embodiment, it should be understood that modifications and variations of the invention may be constructed without departing from the scope of the invention as defined by the following claims.

What is claimed is:

1. A blower housing comprising:

one side of the blower housing that is positioned in a single plane, the single plane of the one side of the blower housing facilitating mounting the one side of the blower housing on a flat surface having a flue opening of a heater with which the blower housing is used;

a fan compartment inside the blower housing and positioned directly above the one side of the blower housing for stable support of the fan compartment when the one side of the blower housing is attached to the flat surface of the heater, the fan compartment having an enclosed interior volume;

a fan inside the fan compartment interior volume;

a motor on the blower housing, the motor being operatively connected to the fan for rotating the fan inside the fan compartment;

a dilution compartment inside the blower housing and positioned on the one side of the blower housing, the dilution compartment having an interior volume that communicates with the fan compartment interior volume, the dilution compartment having a side wall that extends around the dilution compartment interior volume and forms a part of the one side of the blower housing, the side wall having a single dilution air intake opening though the side wall communicating the interior volume of the dilution compartment with an exterior environment of the blower housing, the side wall being dimensioned to extend around and be spaced outwardly from the flue opening of the heater when the one side of the blower housing is mounted on the flat surface of the heater whereby the dilution compartment interior volume is dimensioned sufficiently large to enable mixing of exhaust gas received in the dilution compartment interior volume from the flue opening with ambient air received in the dilution compartment interior volume through the dilution air intake opening, the side wall and the one side of the blower housing providing a continuous engagement with the flat surface of the heater around the flue opening when the one side of the blower housing is mounted on the flat surface of the heater whereby ambient air can enter into the dilution compartment interior volume only through the one dilution air intake opening in the side wall; and a circuitry compartment inside the blower housing and positioned on the one side of the blower housing, the circuitry compartment having at least one wall that extends around an interior volume of the circuitry compartment and forms a part of the one side of the blower housing that is positioned in the single plane.

2. The blower housing of claim 1, further comprising:

a flange projecting outwardly from the blower housing side wall, the flange being positioned in a single plane facilitating mounting the one side of the blower housing to the flat surface of the heater.

3. The blower housing of claim 1, further comprising:

a single air conducting conduit having a length with opposite first and second ends and no branch conduits between the first and second ends, the first end of the conduit communicating with the dilution compartment interior volume through the dilution air intake opening and the second end of the conduit being positioned remote from the blower housing with only ambient air of an exterior environment of the blower housing at the conduit second end.

4. The blower housing of claim 1, further comprising:

the blower housing being inside a room of a structure and the exterior environment being inside the room.

5. The blower housing of claim 3, further comprising:

the blower housing being inside a room of a structure and the exterior environment being outside the room.

6. The blower housing of claim 3, further comprising:

the blower housing being inside a room of a structure and the exterior environment being outside the structure.

7. The blower housing of claim 1, further comprising:

the motor being outside the fan compartment interior volume.

8. The blower housing of claim 1, further comprising:

the fan compartment having an end wall that separates the fan compartment interior volume from the dilution compartment interior volume, the end wall having an exhaust inlet opening through the end wall, and the fan compartment interior volume communicating with the dilution compartment interior volume only through the exhaust inlet opening.

9. A blower housing comprising:

one side of the blower housing that is positioned in a single plane, the single plane of the one side of the blower housing facilitating mounting the one side of the blower housing on a flat surface having a flue opening of a heater with which the blower housing is used;

a fan compartment inside the blower housing and positioned directly above the one side of the blower housing for stable support of the fan compartment when the one side of the blower housing is attached to the flat surface of the heater, the fan compartment having an enclosed interior volume;

a fan inside the fan compartment interior volume;

a motor on the blower housing, the motor being operatively connected to the fan for rotating the fan inside the fan compartment;

a circuitry compartment inside the blower housing and positioned on the one side of the blower housing, the circuitry compartment having an interior volume and at least one wall that extends around the interior volume and forms a part of the one side of the blower housing that is positioned in the single plane and engages with the flat surface of the heater when the one side of the blower housing is mounted on the flat surface of the heater;

a dilution compartment inside the blower housing and positioned on the one side of the blower housing, the dilution compartment having an interior volume that communicates with the fan compartment interior volume, the dilution compartment having a side wall that extends around the dilution compartment interior volume and forms a part of the one side of the blower housing, the side wall having a single dilution air intake opening though the side wall, the side wall being dimensioned to extend around and be spaced outwardly from the flue opening of the heater when the one side of the blower housing is mounted on the flat surface of the heater whereby the dilution compartment interior volume is dimensioned sufficiently large to enable mixing of exhaust gas received in the dilution compartment interior volume from the flue opening with ambient air received in the dilution compartment interior volume through the dilution air intake opening, the side wall and the one side of the blower housing providing a continuous engagement with the flat surface of the heater around the flue opening when the one side of the blower housing is mounted on the flat surface of the heater whereby ambient air can enter into the dilution compartment interior volume only through the one dilution air intake opening in the side wall.

10. The blower housing of claim 9, further comprising:

a flange projecting outwardly from the blower housing side wall, the flange being positioned in a single plane facilitating mounting the one side of the blower housing to the flat surface of the heater.

11. The blower housing of claim 9, further comprising:

a single air conducting conduit having a length with opposite first and second ends and no branch conduits between the first and second ends, the first end of the conduit communicating with the dilution compartment interior volume through the dilution air intake opening and the second end of the conduit being positioned remote from the blower housing with only ambient air of an exterior environment of the blower housing at the conduit second end.

12. The blower housing of claim 11, further comprising:

the blower housing being inside a room of a structure and the exterior environment being inside the room.

13. The blower housing of claim 11, further comprising:

the blower housing being inside a room of a structure and the exterior environment being outside the room.

14. The blower housing of claim 11, further comprising:

the blower housing being inside a room of a structure and the exterior environment being outside the structure.

15. The blower housing of claim 9, further comprising:

the motor being outside the fan compartment interior volume.

* * * * *

UNITED STATES PATENT AND TRADEMARK OFFICE

CERTIFICATE OF CORRECTION

PATENT NO. : 8,079,834 B2
APPLICATION NO. : 10/830695
DATED : December 20, 2011
INVENTOR(S) : Gatley, Jr. et al.

It is certified that error appears in the above-identified patent and that said Letters Patent is hereby corrected as shown below:

On the title page, items (12) and (75):

Replace: "(12) United States Patent
Gatley, Jr."

With: "(12) United States Patent
Gatley, Jr., et al."

Replace: "(75) Inventor: William Stuart Gatley, Jr., Cassville, MO (US)"

With: "(75) Inventor(s): William Stuart Gatley, Jr., Cassville, MO (US); Michael Lynn Kennedy, Cassville, MO (US)"

Signed and Sealed this
Twenty-eighth Day of January, 2014

Michelle K. Lee

Michelle K. Lee
*Deputy Director of the United States Patent and Trademark Office*